US011079167B2

(12) United States Patent
Li et al.

(10) Patent No.: US 11,079,167 B2
(45) Date of Patent: Aug. 3, 2021

(54) STORAGE DEVICE AND REFRIGERATOR HAVING THE SAME

(71) Applicants: QINGDAO HAIER SPECIAL REFRIGERATOR CO., LTD, Qingdao (CN); QINGDAO HAIER JOINT STOCK CO., LTD., Qingdao (CN)

(72) Inventors: Dengqiang Li, Qingdao (CN); Yazhou Shang, Qingdao (CN); Bin Fei, Qingdao (CN); Jinlin Liu, Qingdao (CN)

(73) Assignees: QINGDAO HAIER SPECIAL REFRIGERATOR CO., LTD., Qingdao (CN); QINGDAO HAIER JOINT STOCK CO., LTD., Qingdao (CN)

( * ) Notice: Subject to any disclaimer, the term of this patent is extended or adjusted under 35 U.S.C. 154(b) by 16 days.

(21) Appl. No.: 16/611,474

(22) PCT Filed: Jun. 29, 2018

(86) PCT No.: PCT/CN2018/093536
§ 371 (c)(1),
(2) Date: Nov. 6, 2019

(87) PCT Pub. No.: WO2019/001553
PCT Pub. Date: Jan. 3, 2019

(65) Prior Publication Data

US 2020/0166272 A1 May 28, 2020

(30) Foreign Application Priority Data

Jun. 30, 2017 (CN) ..... 201710527222.2

(51) Int. Cl.
*F25D 23/04* (2006.01)
*A47B 46/00* (2006.01)
*F25D 23/02* (2006.01)
*F25D 25/02* (2006.01)

(52) U.S. Cl.
CPC ..... *F25D 23/04* (2013.01); *A47B 46/00* (2013.01); *F25D 23/028* (2013.01); *F25D 25/02* (2013.01);
(Continued)

(58) Field of Classification Search
CPC ..... F25D 23/028; F25D 23/04; F25D 25/02; F25D 25/022; F25D 25/027; F25D 2331/803; F25D 2331/807
See application file for complete search history.

(56) References Cited

U.S. PATENT DOCUMENTS 2,877,077 A * 3/1959 Robinson ..... F25D 23/04 16/378
3,167,186 A * 1/1965 Squire ..... F25D 25/027 211/150
5,685,624 A * 11/1997 Lee ..... F25D 23/04 312/405.1

FOREIGN PATENT DOCUMENTS

CN 102288001 A 12/2011
CN 202254612 U 5/2012
(Continued)

*Primary Examiner* — Andrew M Roersma
(74) *Attorney, Agent, or Firm* — Cheng-Ju Chiang

(57) ABSTRACT

The present invention provides a storage device for a refrigerator, including: a plurality of boxes, a rotating shaft and a plurality of damping masses, so that the boxes can stay stationary at any rotation position at any time when are rotated around the rotating shaft, which ensures smooth rotation of the boxes during the opening and closing thereof,
(Continued)

and thus facilitates the user to pick and place eggs and improves the stability of the fragile eggs within the rotating boxes.

9 Claims, 6 Drawing Sheets

(52) U.S. Cl.
CPC ..... *F25D 25/022* (2013.01); *F25D 25/027* (2013.01); *A47B 2210/0018* (2013.01); *F25D 2331/803* (2013.01); *F25D 2331/807* (2013.01)

(56) References Cited

FOREIGN PATENT DOCUMENTS

| | | | | | |
|---|---|---|---|---|---|
| CN | 102944102 | A | | 2/2013 | |
| CN | 104089456 | A | | 10/2014 | |
| CN | 204115386 | U | * | 1/2015 | |
| CN | 104344670 | A | * | 2/2015 | |
| CN | 104344670 | A | | 2/2015 | |
| CN | 104534799 | A | | 4/2015 | |
| CN | 104833166 | A | * | 8/2015 | |
| CN | 106766470 | A | | 5/2017 | |
| CN | 107091555 | A | * | 8/2017 | |
| CN | 107218757 | A | | 9/2017 | |
| EP | 2778579 | A1 | * | 9/2014 | ..... F25D 23/04 |
| JP | 2002-87483 | A | | 3/2002 | |
| JP | 2002-130934 | A | | 5/2002 | |
| WO | WO-2011080192 | A2 | * | 7/2011 | ..... F25D 25/027 |
| WO | WO-2015101193 | A1 | * | 7/2015 | ..... F25D 23/04 |

* cited by examiner

STORAGE DEVICE AND REFRIGERATOR HAVING THE SAME

The present application is a 35 U.S.C. § 371 National Phase conversion of International (PCT) Patent Application No. PCT/CN2018/093536, filed on Jun. 29, 2018, which claims the priority to the Chinese Patent Application having an application date of Jun. 30, 2017, an application number of 201710527222.2, and a title of "STORAGE DEVICE AND REFRIGERATOR HAVING THE SAME", which is incorporated herein by reference in its entirety. The PCT International Patent Application was filed and published in Chinese.

TECHNICAL FIELD

The present invention relates to a storage device and in particular to a rotatable sealed storage device suitable for being disposed in a refrigerator.

BACKGROUND

At present, most of the existing egg holders suitable for a refrigerator are simple egg holders, which are placed directly in the bottle holders, racks or drawers. The eggs are easily collided and damaged or contaminated with other foods when exposed to the refrigerator space. Also, it is very inconvenient to pick the eggs from a partially stacked egg holder, which brings great inconvenience to the user.

SUMMARY

An objective of the present invention is to provide a rotatable storage device for placing eggs.

A further objective of the present invention is to enhance the safety of the storage device.

Especially, the present invention provides A storage device for a refrigerator, comprising:

a plurality of boxes, each of which is provided with a plurality of egg grooves for accommodating eggs;

a rotating shaft on which a plurality of engaging portions is disposed at intervals, so that the plurality of boxes is rotatably connected to the plurality of engaging portions at intervals in the axial direction of the rotating shaft, respectively; and a plurality of damping masses configured to be respectively engaged with the outside of the plurality of engaging portions and located between the boxes and the engaging portions, so that the boxes can stay stationary at any rotation position at any time when being rotated around the rotating shaft.

In further, the damping mass comprises a body portion that is configured to have a major segment and a protruding portion that extends outwardly from the planar side of the body portion;

the curved side of the body portion is provided with a rectangular hole, and the rectangular hole is configured to extend inwardly from the lateral center position of the curved side to the rear side of the center of the major segment, so as to be engaged with the outer peripheral side of the engaging portion;

the protruding portion is composed of two mirror-symmetrical minor segments, and forms a base surface that coincides with the planar side of the body portion and a convex curved surface that is smoothly connected with the curved side of the body portion; and the protruding portion has a hollow portion inside, and the hollow portion has a contour that is contoured with the protruding portion.

In further, each of the boxes is provided with a vertically upwardly extending rotating shaft tube and a vertically downwardly extending tubular damping engaging hole which is disposed coaxially with the rotating shaft tube;

the rotating shaft is rotatably disposed within the rotating shaft tube of the plurality of boxes, and the plurality of engaging portions on the rotating shaft are respectively embedded in the damping engaging holes of the plurality of boxes; and the inner wall of the damping engaging hole is provided with at least one recessed portion which is configured to be matched with the protruding portion of the damping mass.

In further, the height of the damping mass is ⅙ to ¼ of the height of the box; and the length of the box is 14 to 18 times the diameter of the body portion of the damping mass, and the width of the box is 6 to 8 times the diameter of the body portion of the damping mass.

In further, each of the boxes comprises a main body on which the plurality of egg grooves is formed and a peripheral wall that surrounds the peripheral side of the main body;

the main body is configured such that a rear section of the main body has a width smaller than that of a front section of the main body, so that the joint between the front section and the rear section is stepped;

the peripheral wall is configured such that the rear wall of the peripheral wall on the rear side of the main body and the upper end edge of the rear side wall of the peripheral wall on the left and right sides of the rear section of the main body are lower than an upper end edge of the front wall of the peripheral wall, and higher than an upper surface of the main body, and that the front wall of the peripheral wall on the front side of the main body and the front side wall of the peripheral wall on the left and right sides of the front section of the main body are equal in height, and the height is not less than twice the height of the main body.

In further, the storage device further comprising:

a support frame having a bottom plate for supporting the plurality of boxes and a back plate extending vertically upwardly from the rear end edge of the bottom plate; wherein the bottom plate has a first limiting portion for mounting the rotating shaft;

the back plate has a side panel that extends forwardly from the left and right end edges of the back plate to form a groove opening forwardly; and the groove is configured such that when the rear section of the main body is located within the groove, the side panel is in abutment with the joint between the front section and rear section of the main body.

In further, the storage device further comprising:

a bottle holder located on the top of the storage device, wherein the lower surface of the bottle holder is provided with a second limiting portion opposite to the first limiting portion to cooperatively fix the rotating shaft.

In further, the storage device further comprising:

a plurality of engaging claws respectively disposed at the joint between the front section and rear section of the main body of the plurality of boxes; and a plurality of engaging grooves disposed at intervals at the front end of the side panel of the support frame and respectively matched with the plurality of engaging claws;

the engaging claws and the engaging grooves are configured such that when the rear section of the main body is located in the groove, the engaging claws are inserted and engaged into the engaging grooves to prevent the box from being rotated; and when the engaging claws are in a state of being engaged into the engaging grooves, the engaging claws can be controlled to continue to be pressed towards the inside of the engaging grooves so as to be disengaged from the engaging grooves, thereby allowing the box to continue to be rotated.

In further, the present invention also provides A refrigerator, the refrigerator comprising a cabinet, a door, and the storage device, wherein the storage device is mounted on the inner wall of the door.

With respect to the storage device according to the present invention, provided is a plurality of damping masses which are respectively matched with a plurality of boxes, so that the boxes can be stopped at any time during the rotatable opening or closing thereof, which ensures smooth rotation of the boxes during the opening and closing thereof, and thus facilitates the user to pick and place eggs and improves the stability of the fragile eggs within the rotating boxes.

In further, the present invention defines a volume ratio of the damping mass suitable for the rotating shaft of the egg holder to the box of the egg holder, so that the damping mass having a specific shape and volume can provide the most appropriate elastic force for the box of the multi-layer egg holder suitable for the refrigerator, so as to enable smoother rotation of the box.

The above and other objectives, advantages and features of the present invention will become apparent for those skilled in the art from the following detailed description of specific embodiments of the present invention with reference to the accompanying drawings.

BRIEF DESCRIPTION OF THE DRAWINGS

Some specific embodiments of the present invention will be described in detail below by way of example and not by way of limitation with reference to the accompanying drawings. The same reference numbers in the accompanying drawings identify the same or similar components or parts. Those skilled in the art should understand that the accompanying drawings are not necessarily drawn according to the scales. In the accompanying drawings.

DETAILED DESCRIPTION

Figure 1:
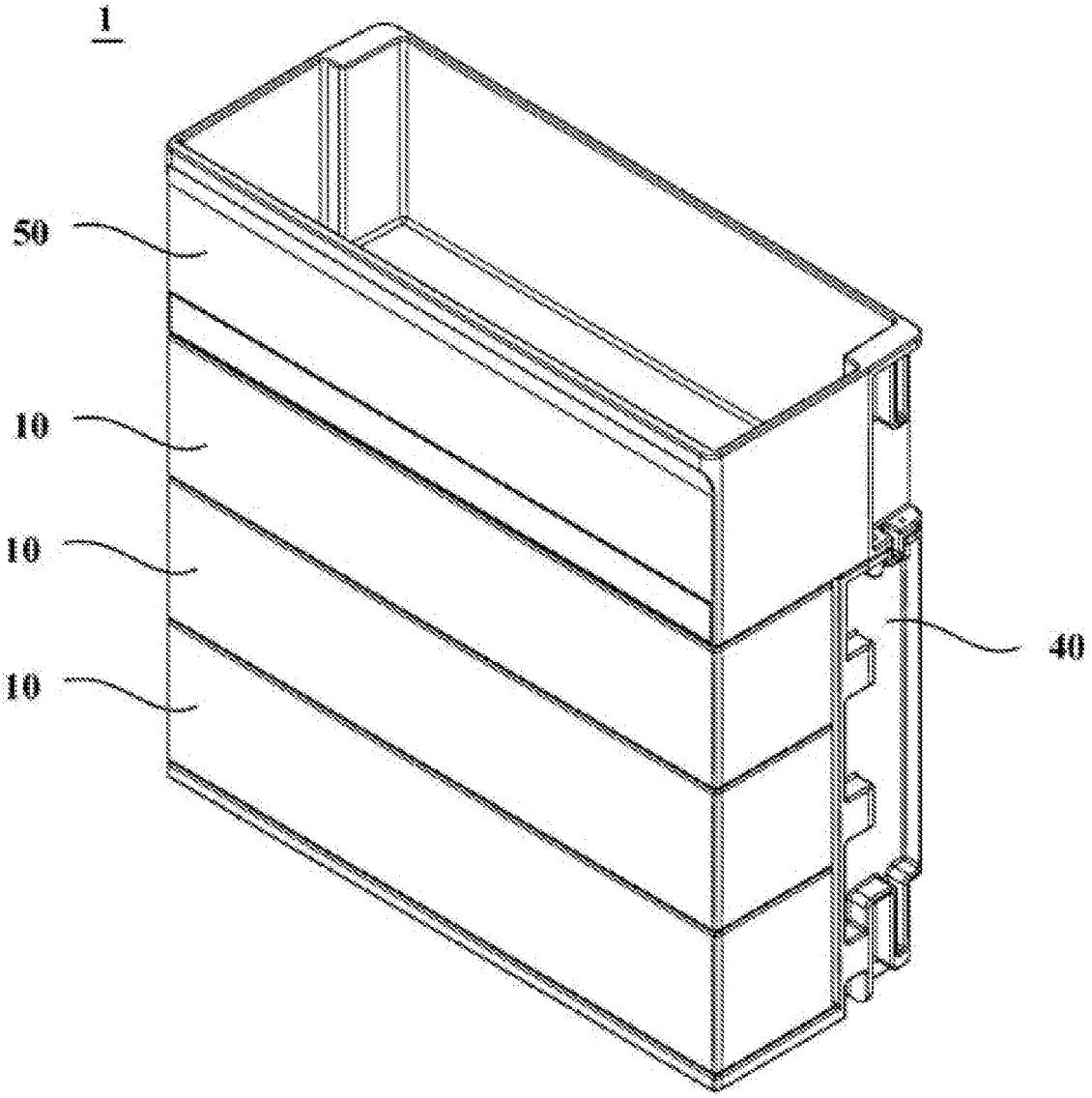
FIG. 1 is a schematic structural view of a storage device for a refrigerator according to an embodiment of the present invention.
Figure 2:
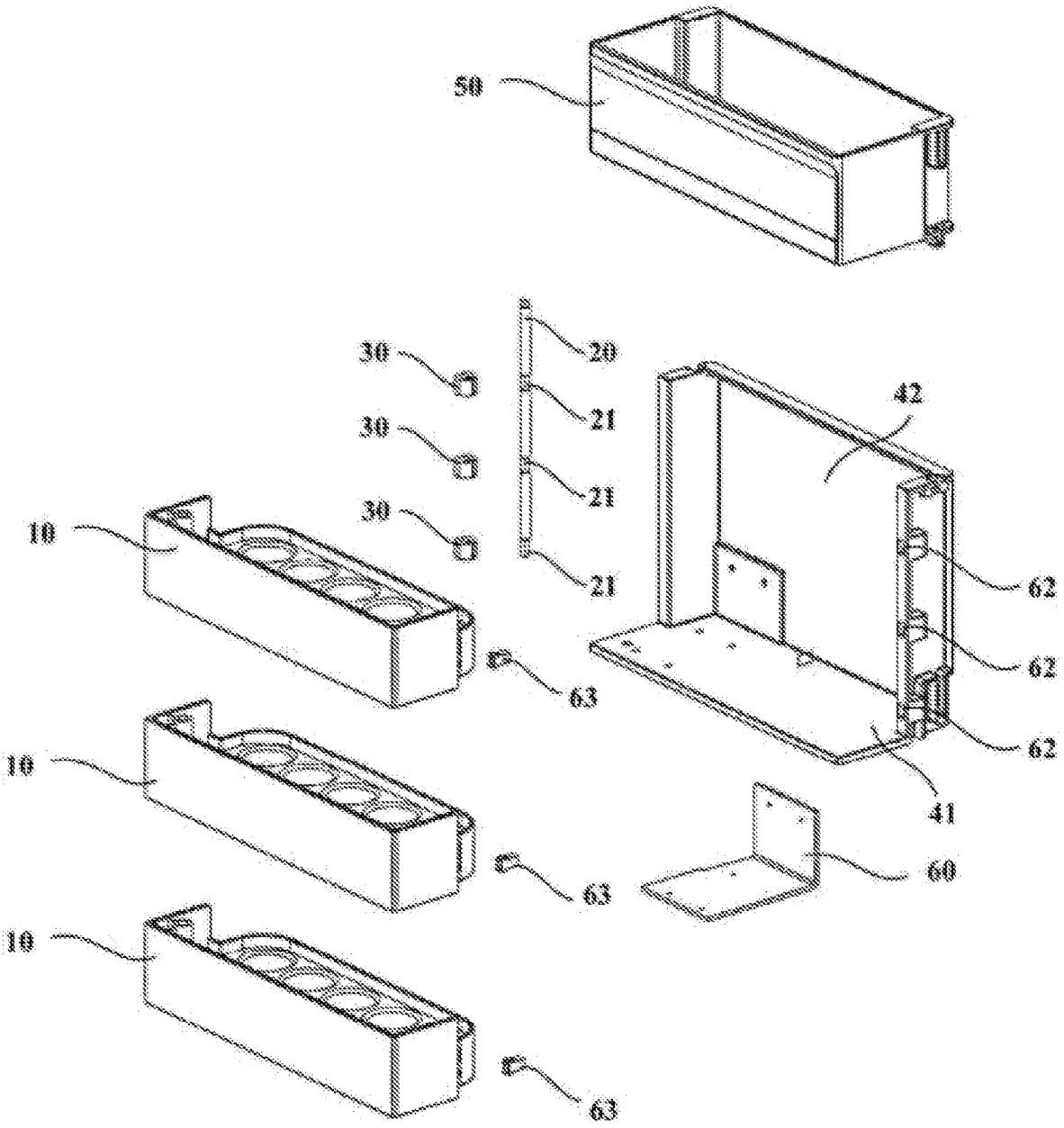
FIG. 2 is a schematic exploded view of the storage device for the refrigerator according to an embodiment of the present invention.

FIG. 1 is a schematic structural view of a storage device 1 for a refrigerator according to an embodiment of the present invention. FIG. 2 is a schematic exploded view of the storage device 1 for the refrigerator according to an embodiment of the present invention. Referring to FIG. 1 and FIG. 2, the storage device 1 includes a plurality of boxes 10, a rotating shaft 20 connecting the plurality of boxes 10, and a plurality of damping masses 30. Each of the boxes 10 is provided with a plurality of egg grooves 100 for accommodating eggs. A plurality of engaging portions 21 is disposed at intervals on the rotating shaft 20, so that the plurality of boxes 10 is rotatably connected to the plurality of engaging portions 21 at intervals in the axial direction of the rotating shaft 20, respectively. The plurality of damping masses 30 is configured to be respectively engaged with the outside of the plurality of engaging portions 21 and located between the boxes 10 and the engaging portions 21, so that the boxes 10 can stay stationary at any rotation position at any time when being rotated around the rotating shaft 20.

The plurality of boxes 10 forms a rotatably opened multi-layer egg holder structure suitable for being disposed on a variety of refrigerating and freezing devices. The refrigerating and freezing device may generally include a cabinet in which a storage space is defined and a door that opens or closes the storage space. The storage device 1 is particularly suitable for being mounted on the inner wall of the door so as to save storage space within the box and to facilitate the user to safely pick and place eggs.

With respect to the storage device 1 according to the present invention, provided is the plurality of damping masses 30 which are respectively matched with the plurality of boxes 10, so that the boxes 10 can be stopped at any time and kept stationary during the rotatable opening or closing of the box, which ensures smooth rotation of the boxes 10 during the opening and closing of the box, and thus facilitates the user to pick and place eggs and improves the stability of the fragile eggs within the rotating boxes 10.

Figure 3:
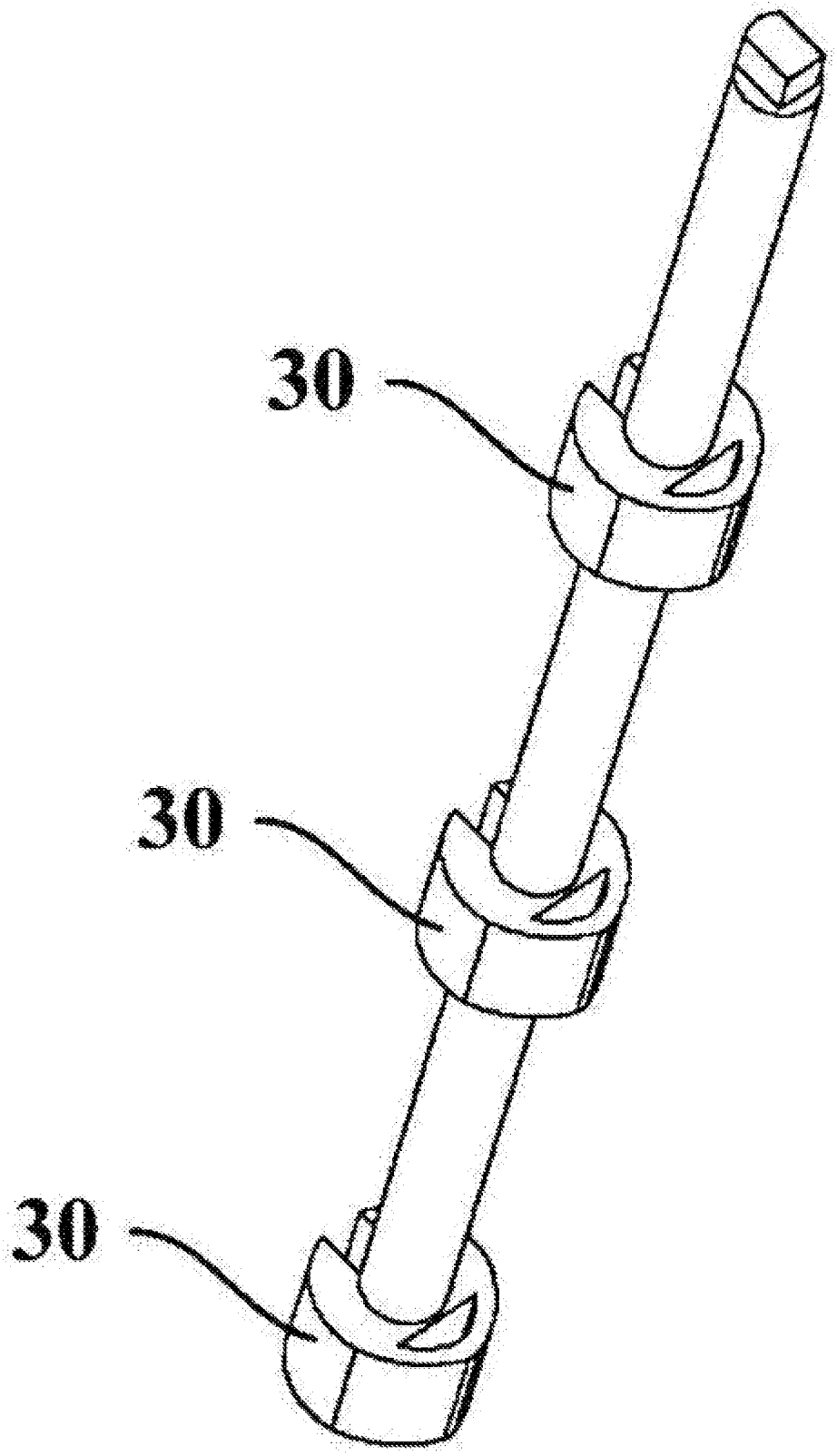
FIG. 3 is a schematic structural view of a rotating shaft and a damping mass according to an embodiment of the present invention.
Figure 4:
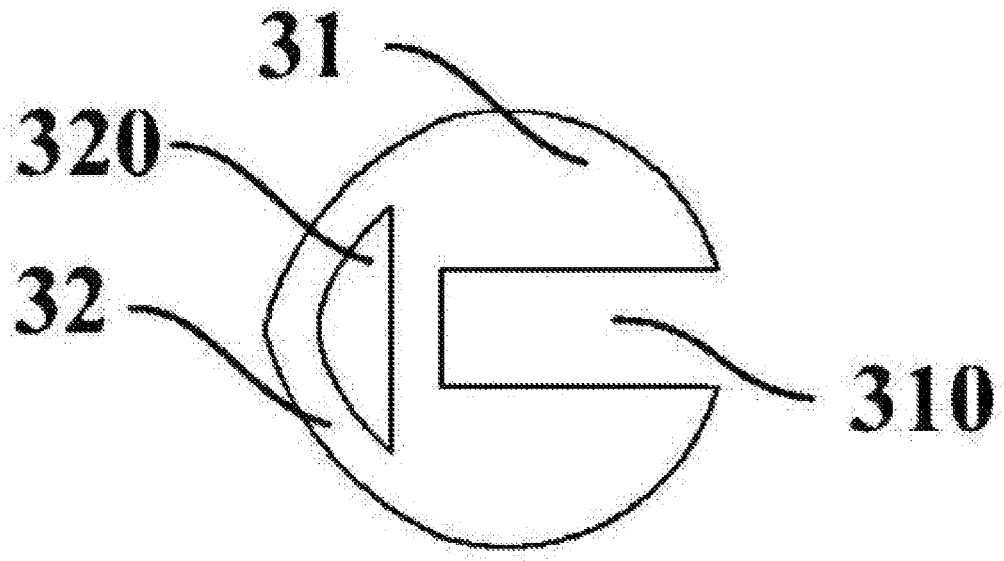
FIG. 4 is a schematic top view of the damping mass according to an embodiment of the present invention.

FIG. 3 is a schematic structural view of a rotating shaft 20 and a damping mass 30 according to an embodiment of the present invention. FIG. 4 is a schematic top view of the damping mass 30 according to an embodiment of the present invention.

Referring to FIG. 3 and FIG. 4, in some embodiments of the present invention, the damping mass 30 includes a body portion 31 that is configured to have a major segment and a protruding portion 32 that extends outwardly from the planar side of the body portion 31. The curved side of the body portion 31 is provided with a rectangular hole 310, and the rectangular hole 310 extends inwardly from the lateral center position of the curved side to the rear side of the center of the major segment, so as to be engaged with the outer peripheral side of the engaging portion 21. The engaging portion 21 has a square cross-sectional contour to increase the contact area of the damping mass 30 with the engaging portion 21 so that the damping mass 30 can be firmly fixed on the rotating shaft 20. The protruding portion 32 is composed of two mirror-symmetrical minor segments, and forms a base surface that coincides with the planar side of the body portion 31 and a convex curved surface that is smoothly connected with the curved side of the body portion 31. The protruding portion 32 has a hollow portion 320 inside, and the hollow portion 320 has a contour that is contoured with the protruding portion 32.

Specifically, the peripheral wall of the engaging portion 21 is square, and is matched with the rectangular hole 310 of the damping mass 30 to fix the damping mass 30. Referring to FIG. 4, the damping mass 30 is configured to have a substantially disk shape with a protrusion (i.e., the protruding portion 32) on the peripheral wall thereof. The hollow portion 320 of the protruding portion 32 is pressed against the box 10 and is deformed when the box 10 is rotated.

Unlike some conventional damping members that are configured to have a multi-teeth-shaped structure such as a gear teeth or a gear plate, the present invention proposes a breakthrough that the damping mass 30 has a disk shape with a relatively smooth convex, and creatively proposes that a hollow portion 320 is defined on the protruding portion 32, so as to cause a large deformation (relative to the solid damping member) of the protruding portion 32 when compressed by an external force to reduce the frictional resistance, and to decelerate the wear of the damping mass 30 so as to prolong the service life thereof while ensuring that the protruding portion 32 can provide the necessary resistance required by the rotating body (that is, the box 10) to maintain stable rotation and to be easy to control, and to smooth the rotation process of the box 10, and enable the box 10 to be stopped at any time and kept stationary more smoothly.

Figure 5:
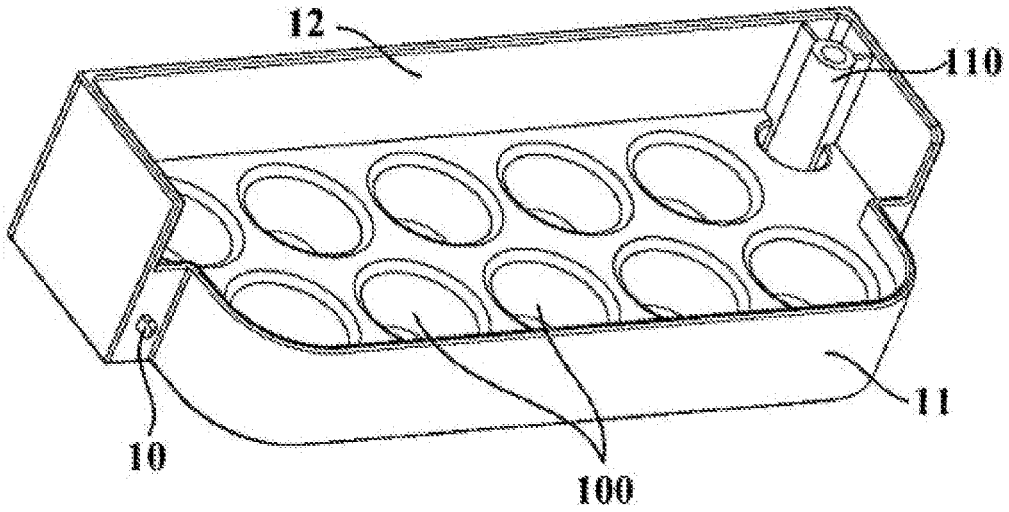
FIG. 5 is a schematic structural view of a box according to an embodiment of the present invention.
Figure 6:
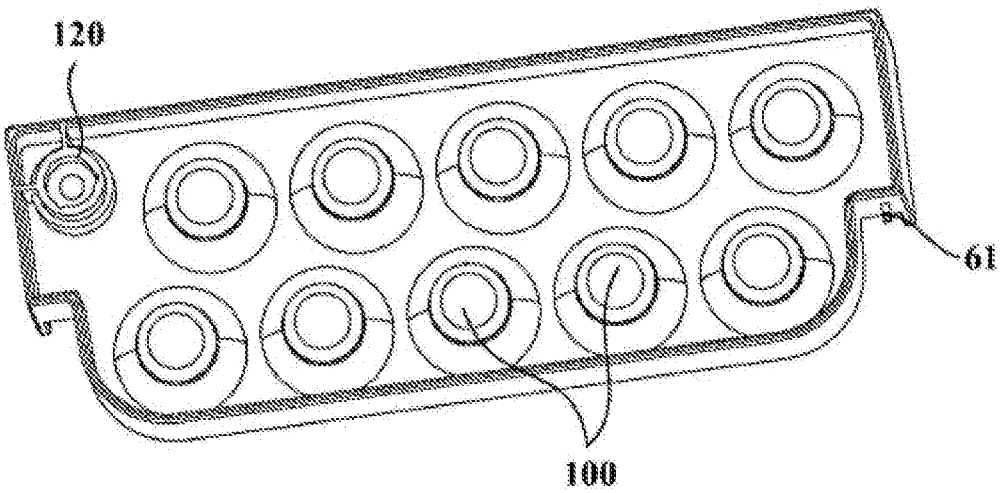
FIG. 6 is a schematic structural view of the box viewed from another angle according to an embodiment of the present invention.

FIG. 5 is a schematic structural view of a box 10 according to an embodiment of the present invention. FIG. 6 is a schematic structural view of the box 10 viewed from another angle according to an embodiment of the present invention.

Referring to FIG. 5 and FIG. 6, in some embodiments of the present invention, each of the boxes 10 is provided with a vertically upwardly extending rotating shaft tube 110 and a vertically downwardly extending tubular damping engaging hole 120 which is disposed coaxially with the rotating shaft tube 110. The rotating shaft 20 is rotatably disposed within the rotating shaft tube 110 of the plurality of boxes 10, and the plurality of engaging portions 21 on the rotating shaft 20 is respectively embedded in the damping engaging holes 120 of the plurality of boxes 10. The inner wall of the damping engaging hole 120 is provided with at least one recessed portion which is configured to be matched with the protruding portion 32 of the damping mass 30.

Specifically, there may be two recessed portions, and the two recessed portions are disposed at intervals along the peripheral wall of the damping engaging hole 120 to position the different rotation positions of the box 10.

In some embodiments of the present invention, the height of the damping mass 30 is ⅙ to ¼ of the height of the box 10. The length of the box 10 is 14 to 18 times the diameter of the body portion 31 of the damping mass 30, and the width of the box 10 is 6 to 8 times the diameter of the body portion 31 of the damping mass 30.

Through deep research of the structural force of the egg holder for the refrigerator, and according to the size of the egg holder and the number and weight of eggs that can be placed on the egg holder, the inventor creatively defines a volume ratio of the damping mass suitable for the rotating shaft 20 of the egg holder to the box 10 of the egg holder, so that the damping mass 30 having a specific shape and volume can provide the most appropriate elastic force for the box 10 of the multi-layer egg holder suitable for the refrigerator, so as to enable smoother rotation of the box.

Referring to FIG. 3, in some embodiments of the present invention, each of the boxes 10 includes a main body 11 on which a plurality of egg grooves 100 is formed and a peripheral wall 12 that surrounds the peripheral side of the main body 11. The main body 11 is configured such that a rear section thereof has a width smaller than that of a front section thereof so that the joint between the front section and the rear section is stepped.

Further, the peripheral wall 12 is configured such that the rear wall of the peripheral wall 12 on the rear side of the main body 11 and the upper end edge of the rear side wall of the peripheral wall 12 on the left and right sides of the rear section of the main body 11 are lower than an upper end edge of the front wall of the peripheral wall 12, and higher than an upper surface of the main body 11, and that the front wall of the peripheral wall 12 on the front side of the main body 11 and the front side wall of the peripheral wall 12 on the left and right sides of the front section of the main body 11 are equal in height, and the height is not less than twice the height of the main body 11.

That is, a part of the side wall higher than the main body 11 can protect the eggs placed within the egg grooves 100, and can separate the eggs in the box 10 from other storage spaces of the refrigerator to ensure that the eggs and the storage space of the refrigerator are clean.

In some embodiments of the present invention, referring to FIG. 2, the storage device 1 further includes a support frame 40 having a bottom plate 41 for supporting the plurality of boxes 10 and a back plate 42 extending vertically upwardly from the rear end edge of the bottom plate 41. The bottom plate 41 has a first limiting portion for mounting the rotating shaft 20. The back plate 42 has a side panel that extends forwardly from the left and right end edges of the back plate 42 to form a groove opening forwardly. The groove is configured such that when the rear section of the main body 11 is located within the groove, the side panel is in abutment with the joint between the front section and rear section of the main body 11.

That is, the peripheral wall 12 of the box 10 and the back plate 42 of the support frame 40 cooperatively surround the main body 11 in which the eggs are placed within a square tubular space defined by the peripheral wall 12 and the back plate 42, which further increases the use safety of the storage device 1.

Further, the support frame 40 may further include a reinforcing plate 60. The reinforcing plate 60 includes: a bottom reinforcing member which is disposed under the bottom plate 41 of the support frame 40 and is configured to mount the rotating shaft 20, and a rear reinforcing member which is integrally formed with the bottom reinforcing member and is located on the rear side of the back plate 42 of the support frame 40.

In some embodiments of the present invention, referring to FIG. 2, the storage device 1 further includes a bottle holder 50. The bottle holder 50 is located on the top of the storage device 1, and the lower surface of the bottle holder 50 is provided with a second limiting portion opposite to the first limiting portion to cooperatively fix the rotating shaft 20.

That is, the egg holder having a plurality of boxes 10 may be mounted under the bottle holder 50 to form a composite storage device 1, which enhances the utility of the storage device 1. Further, the bottle holder 50 may also be used as an upper cover for a multi-layer box 10 to accommodate the main body 11 of the multi-layer box 10 within an enclosed space together with the peripheral wall 12 of the multi-layer box 10 and the back plate 42 of the support frame 40, which enhances the safety of the box 10.

Figure 7:
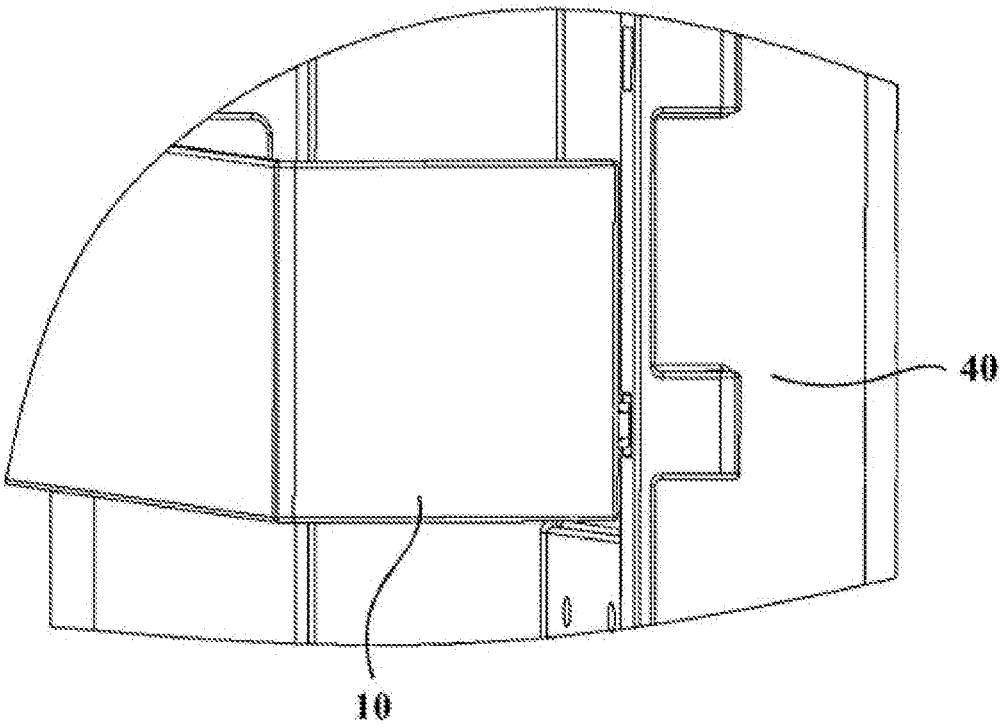
FIG. 7 is a partial schematic structural view of a self-locking device in a locked state, according to an embodiment of the present invention.
Figure 8:
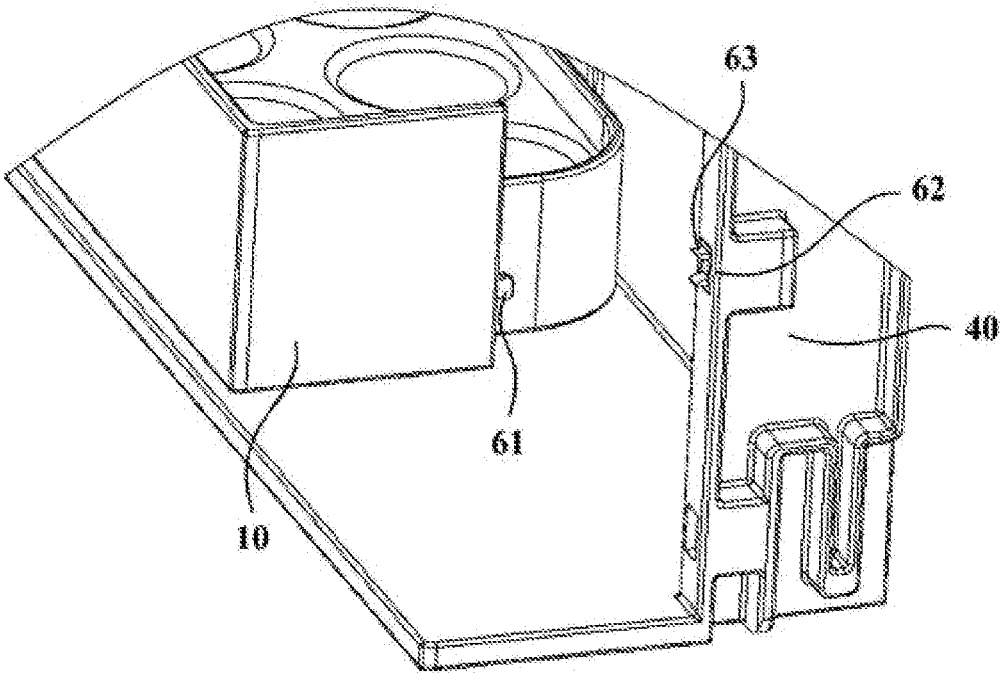
FIG. 8 is a partial schematic structural view of the self-locking device in an unlocked state, according to an embodiment of the present invention.

FIG. 7 is a partial schematic structural view of a self-locking device in a locked state, according to an embodiment of the present invention. FIG. 8 is a partial schematic structural view of the self-locking device in an unlocked state, according to an embodiment of the present invention.

Referring to FIG. 7 and FIG. 8, in some embodiments of the present invention, the storage device 1 further includes a plurality of engaging claws 61 and a plurality of engaging grooves 62. The plurality of engaging claws 61 may be respectively disposed at the joint between the front section and rear section of the main body 11 of the plurality of boxes 10. The plurality of engaging grooves 62 is disposed at intervals at the front end of the side panel of the support frame 40 and are respectively matched with the plurality of engaging claws 61. The engaging claws 61 and the engaging grooves 62 are configured such that when the rear section of the main body 11 is located in the groove, the engaging claws 61 are inserted and engaged into the engaging groove 62 to prevent the box 10 from being rotated and opened. Further, when the engaging claws are in a state of being engaged into the engaging grooves, the engaging claws can be controlled to continue to be pressed towards the inside of the engaging grooves so as to be disengaged from the engaging grooves, thereby allowing the box to continue to be rotated.

Specifically, a push switch 63 may be disposed within each of the engaging grooves 62. The engaging claw 61, the engaging groove 62 and the push switch 63 can cooperatively form a self-locking structure. When the box 10 is rotated to the closed position, the engaging claw 61 is directly inserted into the engaging groove 62, and is engaged with the push switch 63 to lock the box 10 and the support frame 40 with each other, which ensures that the egg holder is in a locked state when the box 10 is closed and ensures that the egg holder is not displaced due to the closing force during the closing of the refrigerator door. When the user needs to pick and place the eggs, the outside of the box 10 can be pressed and the box 10 is pressed towards the support frame 40, at this point, the engaging claw 61 can open the push switch 63 within the engaging groove 62, thereby being smoothly disengaged from the engaging groove 62, so that the box 10 can be restored to a free rotatable state.

With this, it will be appreciated by those skilled in the art that, although a plurality of exemplary embodiments of the present invention has been shown and described in detail herein, many other variations or modifications consistent with the principles of the present invention can be directly determined or derived from the content disclosed in the present invention without departing from the spirit and scope of the present invention. Therefore, the scope of the present invention should be understood and construed as covering all such other variations or modifications.

What is claimed is:

1. A storage device for a refrigerator, comprising:

a plurality of boxes, wherein each of the plurality of boxes is provided with a plurality of egg grooves for accommodating eggs;

a rotating shaft on which a plurality of engaging portions is disposed at intervals, so that the plurality of boxes is rotatably connected to the plurality of engaging portions at intervals in an axial direction of the rotating shaft, respectively; and a plurality of damping masses configured to be respectively engaged with an outside of the plurality of engaging portions and located between the boxes and the engaging portions, so that the boxes can stay stationary at any rotation position at any time when being rotated around the rotating shaft; wherein each of said plurality of damping masses comprises a body portion and a protruding portion that extends outwardly from a planar side of the body portion, and the protruding portion has a hollow portion inside, and the hollow portion has a contour that is contoured with the protruding portion.

2. The storage device according to claim 1, wherein:

the body portion is configured to have a major segment;

the curved side of the body portion is provided with a rectangular hole, and the rectangular hole is configured to extend inwardly from a lateral center position of the curved side to a rear side of a center of the major segment, so as to be engaged with an outer peripheral side of the engaging portion;

the protruding portion is composed of two mirror-symmetrical minor segments, and forms a base surface that coincides with the planar side of the body portion and a convex curved surface that is smoothly connected with the curved side of the body portion.

3. The storage device according to claim 2, wherein:

each of the boxes is provided with a vertically upwardly extending rotating shaft tube and a vertically downwardly extending tubular damping engaging hole which is disposed coaxially with the rotating shaft tube;

the rotating shaft is rotatably disposed within the rotating shaft tube of the plurality of boxes, and the plurality of engaging portions on the rotating shaft are respectively embedded in the damping engaging holes of the plurality of boxes; and an inner wall of the damping engaging hole is provided with at least one recessed portion which is configured to be matched with the protruding portion of the damping mass.

4. The storage device according to claim 2, wherein:

a height of the damping mass is ⅙ to ¼ of a height of the box; and a length of the box is 14 to 18 times a diameter of the body portion of the damping mass, and a width of the box is 6 to 8 times the diameter of the body portion of the damping mass.

5. The storage device according to claim 2, wherein:

each of the boxes comprises a main body on which the plurality of egg grooves is formed and a peripheral wall that surrounds a peripheral side of the main body;

the main body is configured such that a rear section of the main body has a width smaller than that of a front section of the main body, so that a joint between the front section and the rear section is stepped;

the peripheral wall is configured such that a rear wall of the peripheral wall on the rear section of the main body and an upper end edge of the rear side wall of the peripheral wall on the left and right sides of the rear section of the main body are lower than an upper end edge of a front wall of the peripheral wall, and higher than an upper surface of the main body, and that the front wall of the peripheral wall on the front section of the main body and the front wall of the peripheral wall on left and right sides of the front section of the main body are equal in height, and the height is not less than twice a height of the main body.

6. The storage device according to claim 5, further comprising:

a support frame having a bottom plate for supporting the plurality of boxes and a back plate extending vertically upwardly from a rear end edge of the bottom plate; wherein the bottom plate has a first limiting portion for mounting the rotating shaft;

the back plate has a side panel that extends forwardly from left and right end edges of the back plate to form a groove opening forwardly; and the groove is configured such that when the rear section of the main body is located within the groove, the side panel is in abutment with the joint between the front section and rear section of the main body.

7. The storage device according to claim 6, further comprising:

a bottle holder located on a top of the storage device, wherein a lower surface of the bottle holder is provided with a second limiting portion opposite to the first limiting portion to cooperatively fix the rotating shaft.

8. The storage device according to claim 6, further comprising:

a plurality of engaging claws respectively disposed at the joint between a front section and rear section of the main body of the plurality of boxes; and a plurality of engaging grooves disposed at intervals at the front end of the side panel of the support frame and respectively matched with the plurality of engaging claws;

the engaging claws and the engaging grooves are configured such that when the rear section of the main body is located in the groove, the engaging claws are inserted and engaged into the engaging grooves to prevent the box from being rotated; and when the engaging claws are in a state of being engaged into the engaging grooves, the engaging claws are able to be pressed towards an inside of the engaging grooves so as to be disengaged from the engaging grooves, thereby allowing the box to be rotated.

9. A refrigerator comprising a cabinet, a door, and the storage device according to claim 1, wherein the storage device is mounted on an inner wall of the door.

* * * * *